US006123606A

United States Patent [19]

Hill et al.

[11] Patent Number: 6,123,606

[45] Date of Patent: Sep. 26, 2000

[54] METHOD AND APPARATUS FOR GRINDING

[75] Inventors: Christopher P R Hill; James R Watkins, both of Bristol; Charles Ray, Rugby, all of United Kingdom

[73] Assignee: Rolls-Royce PLC, London, United Kingdom

[21] Appl. No.: 09/210,772

[22] Filed: Dec. 14, 1998

[30] Foreign Application Priority Data

Dec. 22, 1997 [GB] United Kingdom ..... 9726981

[51] Int. Cl.[7] ..... B24B 1/00

[52] U.S. Cl. ..... 451/53; 451/178; 451/449; 451/450; 451/488

[58] Field of Search ..... 451/53, 178, 449, 451/450, 488

[56] References Cited

U.S. PATENT DOCUMENTS 4,712,334 12/1987 Ikezaki et al. ..... 451/450
4,944,121 7/1990 Takahashi et al. ..... 451/450
5,251,408 10/1993 Boaz ..... 451/450
5,410,843 5/1995 Gottschald ..... 451/450
5,414,963 5/1995 Watanabe et al. ..... 451/450
5,611,724 3/1997 DeGraff ..... 451/450

*Primary Examiner*—David A. Scherbel
*Assistant Examiner*—Shantese McDonald
*Attorney, Agent, or Firm*—Oliff & Berridge, PLC

[57] ABSTRACT

The material removal rate of a creep-feed grinding operation may be increased significantly by use of a type of porous grinding wheel in combination with jet of coolant liquid at high pressure directed at the periphery of the wheel in advance of the cutting point. The apparatus for performing the method may comprise a multi-axis machining centre adapted to enable the coolant nozzle(s) to be retracted to provide working clearance for automatic tool changer operation and to re-position the aiming point of the nozzle(s) over an angular range relative to a cutting point.

20 Claims, 2 Drawing Sheets

METHOD AND APPARATUS FOR GRINDING

BACKGROUND OF THE INVENTION

Field of the Invention

The invention concerns a method and apparatus for grinding. In particular, it relates to an enhancement to a process called creep-feed grinding by means of which a very high stock removal rate is achieved.

SUMMARY OF THE INVENTION

According to the present invention in its broadest aspect there is provided apparatus for high speed grinding comprises a porous grinding wheel, a machine for mounting and rotating the grinding wheel at peripheral speeds up to about 80 metres per second, a high pressure coolant supply system including at least one nozzle means for directing a jet of coolant at high pressure at an aiming point on the periphery of the grinding wheel substantially in advance of the machining point.

Furthermore, there is provided a method of carrying out a grinding operation at a very high stock removal rate includes the steps of setting a grinding wheel for a deep cut at a machining point, and directing a jet of liquid at very high pressure at an aiming point on the periphery of the grinding wheel substantially in advance of the machining point.

The method and apparatus of the invention, and how the same may be carried into practice, will now be described with, by way of example only, reference to the accompanying drawings.

Creep-feed grinding is a full depth or full cut operation which often allows a complete profile depth to be cut from solid in a single pass. The workpiece to be machined is fixed to a surface table which is fed passed the rotating grinding wheel at a constant speed. The stock removal rate is set by the size and number of chip cavities in the surface of the wheel in combination with a number of other factors. A high removal rate can be achieved if the chip cavities are almost filled, but full or impacted cavities can generate sufficient frictional heat to burn the workpiece surface and damage the wheel. Increasing the depth of wheel cut hitherto has required reduced workpiece feed rate or performing the operation in two or more passes. Some improvements have been found by providing adequate coolant flow to the wheel contact region ensuring workpiece cooling and grinding wheel cooling and efficient cleaning. It is well known to use jet cleaning nozzles delivering coolant close to the wheel surface in large volumes at typical delivery pressures of up to about 4 bar. The type and composition of the wheel is carefully chosen for the type of material to be ground for the most acceptable balance between stock removal rate and wheel wear. Prudent choice of components and operating variables can mean that the removal rate of the best combination may be up to twice as high as another configuration.

We have found the surprising result that removal rates substantially greater than typical normal rates can be achieved with a novel combination of small diameter wheel, coolant delivery pressure and point of coolant jet impact on the wheel.

The present invention is carried into practice using a multi-axis milling machine adapted to operate using a grinding wheel in place of the normal milling cutter. A main reason for using a multi-axis machine of this kind is its ability to reproduce complex surface profiles on the ground workpiece, although this particular topic is outside the scope of the present invention. It is to be understood, therefore, that the relative motions of the grinding wheel and workpiece may be compound movements, notwithstanding that for simplicity the accompanying drawing represents such relative movement as rectilinear.

BRIEF DESCRIPTION OF THE DRAWINGS

The invention will now be described in greater detail with reference, by way of example only, to the arrangements illustrated in the accompanying drawings in which.

DETAILED DESCRIPTION OF THE PREFERRED EMBODIMENTS

Figure 1:
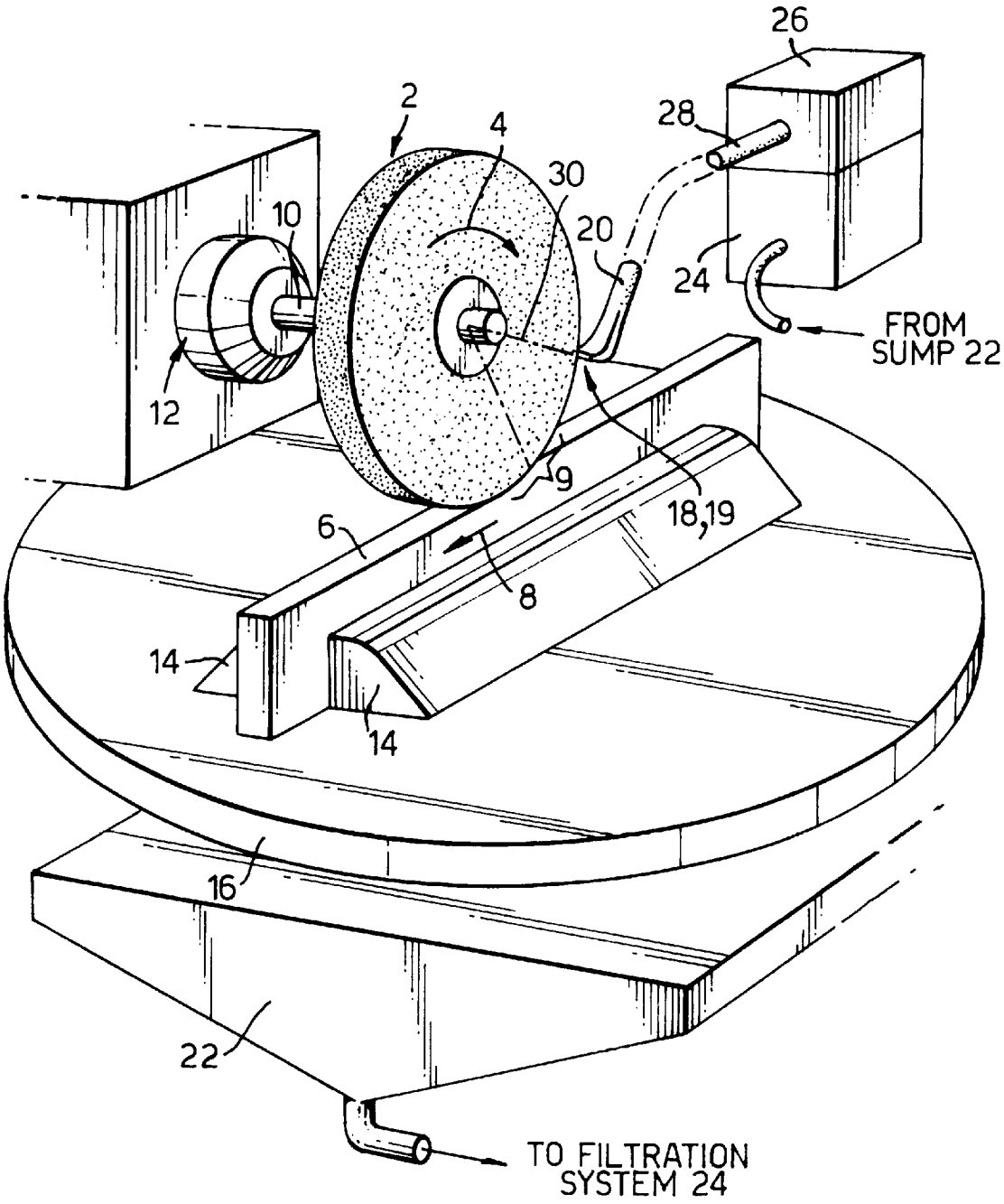
FIG. 1 is a schematic diagram to illustrate the basic principle of the invention.

For the purposes of illustrating the principles of a grinding process incorporating the invention, FIG. 1 shows a grinding set-up which comprises a grinding wheel 2 rotating in the direction of arrow 4 while a workpiece 6 is fed past the wheel 2 in the relative direction of arrow 8. In the illustrated example this produces an operation known in the art as "down" grinding in a contact region generally indicated at 9. The invention is found to work just as well with "up" grinding. Essentially the process of the invention is a developed form of the process known as creep-feed grinding, although this may be regarded as something of a misnomer since the enhancement results is very much faster removal of workpiece material.

The grinding wheel 2 is mounted on a rotary spindle 10 carried by a tool head or chuck 12 which is part of a standard multi-axis machine. The workpiece 6 is held by means of a mounting fixture 14 on a surface mounting table 16. Since the invention is intended to be a "one-pass" grinding process the width of the grinding wheel is, of course, determined by the corresponding width of the ground surface required. We have found no significant variation of results using grinding wheels in a width range of 10 mm to 45 mm providing the surface speed is maintained constant. On the other hand we have found no indication of a width limit and the invention may be expected to be useful regardless of the width of the grinding wheel, other considerations aside.

The range of values of surface speed for the type of grinding wheel employed within which enhancement was achieved was from about 10 metres per second up to about 80 metres per second. Wheels of various diameters gave consistent results providing surface speed was matched with all other parameters. The maximum diameter of grinding wheel used to date is approx 400 mm, but this upper limit was imposed by physical clearance in the operative region of the machine, rather than by the inherent stability of the wheel construction. Obviously grinding wheels by the nature of their composition and construction possess limitations in terms of maximum rotational speed, depth of cut achievable to name but two, but in this example these did not curtail the operational parameters of the process. Thus, where the machine permits in respect of size, and speed higher figures may be expected to be achieved.

A jet 18 of liquid coolant, comprising a water soluble oil, is directed through nozzle means 20 at an aiming point 19 on the periphery of wheel 2. The nozzle 20 is the outlet of a closed-loop coolant delivery, collection and filtration system. Spent coolant ejected from the wheel is collected in a sump 22, in the lower part of the machine, and drawn-off through an efficient filtration system 24 to remove debris down to a particle size, typically of at least, about 10 micron.

Integral with the filtration system 24 is a very high pressure pump system 26 which delivers coolant under pressure through outlet 28 to the delivery nozzle 20. In the illustrated embodiment the coolant supply is delivered via the outlet 28 at a pressure of up to 100 bar, typically 70 bar, at a flow rate of up to about 60 liters per minute. We have found the significant improvement to be achieved using a coolant delivered within a range of pressure from about 40 Bar to about 70 Bar.

The nozzle 20 is positioned close to the periphery of wheel 2 to deliver the very high pressure jet 18 of coolant at the wheel in a substantially radial direction to the wheel circumference at a point approximately 45° in advance of the cutting region on workpiece 6. The nozzle 20 is constructed and arranged to direct a jet 18 of coolant fluid in a direction perpendicular to the periphery of the wheel at the impact point across the full width of the wheel. In the embodiment the nozzle 20 has a jet orifice which is approximately rectangular having a length approximately equal to the width of the wheel 2 and which is 0.5 mm to 1 mm in depth. This orifice, therefore, directs a jet 18 of coolant in the shape of a sheet or fan at the periphery of the wheel to obtain substantially even distribution of coolant across the width of the wheel. If a wheel 2 of different width is employed the coolant nozzle 20 is also changed to match. For example where a grinding wheel much wider than the width of a single nozzle is used, then two such nozzles may be mounted side-by-side to produce a combined coolant/lubricant jet spanning the whole width of the wheel. Two nozzles may be preferred to a single double-width nozzle to avoid the need to change the nozzles to suit the wheel, because in a double nozzle arrangement one of the nozzles may be fed through an on-off valve to avoid wastage.

Also, in the drawing, a pair of radii 30,32 are shown (in chain-line) centred on the wheel spindle 10. A first radius 30 is drawn through the impingement region of the jet 18 on the periphery of the wheel 2, while the second radius 32 is drawn through the contact point between the wheel 2 and the workpiece 6. The included angle between these two radii 30,32 defines the circumferential position of the impact point of jet 18. It will be apparent from the illustration of the present embodiment, which used a wheel diameter of approximately 80 mm at the smaller end of the range, that this included angle is approximately 45° and the jet 18 is in advance of the grinding wheel contact point. It follows, therefore that if the machine is changed to an "up" grinding process the impact point of the coolant jet 18 must be altered correspondingly. As different wheel diameters were tried we found it best, in order to maintain improved performance, to keep a substantially constant distance between the jet impingement point and the wheel cutting point. Thus, as wheel diameter was increased the angle of advance decreased in inverse proportion. The distance separating the grinding wheel cutting point and the coolant aiming point as the periphery of the grinding wheel appears to remain substantially constant regardless of the diameter of the grinding wheel. However, the magnitude of that distance to obtain best results is influenced by several factors, principally it would appear by wheel surface speed and porosity. Thus, in the example quoted above using a vitrified porous wheel the best coolant aiming point was found to be in a region 30 mm to 40 mm in advance of the cutting point.

It will be appreciated that the effect achieved with the invention is to some extent variable with changes to the several parameters involved. Our experience so far is that at the coolant delivery pressure mentioned a nozzle position of about 45° in advance of the contact point achieved maximum effect with the size and kind of grinding wheel described. Although this positioning was found not to be supercritical tests demonstrated that the significant advantage to stock removal rate was not achieved with conventional coolant injection into the contact region 9. In fact, it was found that coolant injection into that region could have a detrimental effect by precipitating skidding of the grinding wheel. Also it was found that coolant directed at the wheel periphery in a broad range of the circumference on the opposite side of the grinding wheel did not yield the dramatic improvement of elsewhere.

The significant enhancement of the invention seems principally to be dependent upon the extremely high, by conventional standards, coolant pressure as well as the positioning of the coolant jet in conjunction with a porous wheel. In conventional grinding processes the pressure of coolant flow is normally of the order of 1 to 2 Bar, and in the prior art pressures about to 5 Bar are referred to as a high pressure. We have found that at these orders of coolant pressure no significant advantage can be found using any type of grinding wheel. It may be that with still higher coolant delivery pressures that the desired effect may be achieved over a greater range of included angle or is at a peak at a slightly different angle. The difficulty and expense of experimenting with substantially different delivery pressures, because of the size and cost of the filtration and pumping system, precludes such contingent experimentation.

Figure 2:
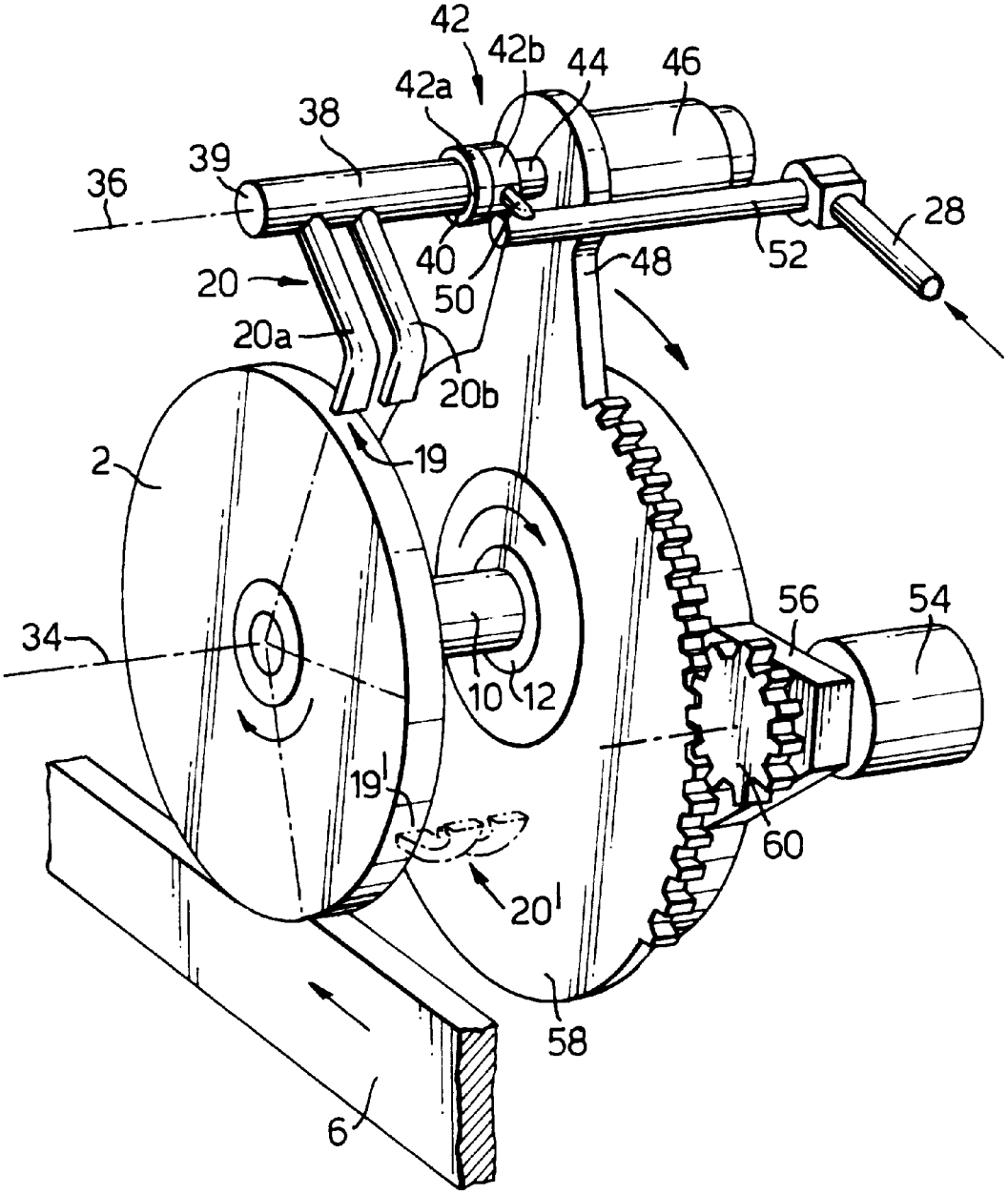
FIG. 2 illustrates a coolant nozzle arrangement employed in one embodiment of the invention on a multi-axis machining centre.

A practical nozzle arrangement is shown in FIG. 2, in comparison with the drawing of FIG. 1 like parts carry like references. Thus, as before, the grinding wheel 2 is mounted on a machine spindle 12 for rotation about axis 30 and nozzle means 20 is positioned, during grinding operations, just in advance of the contact region. However, in order that the grinding operation may be fully integrated into a modern manufacturing process it is carried out on a multi-axis machining centre and the nozzle mounting arrangement is adapted accordingly to cater for an automatic tool change function and a variety of grinding wheel diameters.

In the embodiment illustrated in FIG. 2 the nozzle means 20, in order to cater for a range of wheel diameters, comprises two individual nozzles 20*a*,20*b* mounted in tandem. The disposition of the nozzles is such that a first of the nozzles 20*a* is aligned with a narrow width grinding wheel. Wider wheels are positioned so that the additional width lies within the converge of the second nozzle 20*b*. The coolant supply system (to be described in more detail below) may include valve means to stem flow through nozzle 20*b* when a narrow grinding wheel is in use.

The tool spindle 10 is mounted in a chuck 12 for rotation about axis 30. The wheel 2, or any other tool, together with the spindle 10 is demountable from the chuck 12 and may be exchanged from any other tool, for example a wheel of another diameter, by an automatic tool changer mechanism. Such tool changers are well in the machine tool field, normally the installation includes a library or store of rotary tools each of which is mounted on its own spindle. On a control command the chuck 12 releases the spindle 10 and a robot arm (not shown) grasps the tool and/or the spindle and exchanges it with another in the tool store. The new spindle 10 is inserted into the chuck 12 which is automatically tightened. This whole process is accomplished in a fraction of a second and requires no operator intervention. The coolant delivery nozzle means 20 therefore presents a potential obstruction unless it is cleared from a volume immediately surrounding the tool (grinding wheel) 2.

The tip (exit orifice) of the nozzle 20*a*,20*b* in use is preferably positioned very close to the peripheral surface of the grinding wheel 2. As a result there is a distinct possibility of the nozzles coming into contact with the wheel 2 during a tool change sequence, and damage may be caused. Therefore, it is arranged for the nozzle means 20 (ie both nozzles 20*a*,20*b*) to be retracted during a tool change operation to clear a volume around about and including the tool itself. This may be of particular importance if the new tool comprises, for example, a grinding wheel 2 of larger diameter.

Accordingly the nozzle means 20 and the coolant supply system is adapted to allow the nozzles 20*a*,20*b* to be swung away from the tool volume. In the present arrangement these nozzles are thus mounted to be swung away about an axis 36 parallel to and spaced from the tool spindle axis 34. It follows, of course, that there must also be sufficient separation between the axis 34 and the periphery of the largest diameter grinding wheel 2.

The nozzles 20*a*,20*b* are joined to a tubular supply conduit 38 disposed concentrically with axis 36. One end 39 of the tabular conduit 38 is closed while the opposite end 40 is joined in flow communication with an outlet of a rotary union 42, comprising a rotary portion 42*a* (to which conduit 38 is joined) and a stationary portion 42*b*. The portions 42*a*,42*b* are relatively rotatable by a mechanical rotary input from a shaft 44 driven by a stepper motor 46 which is carried by a yoke arm 48 (see further below).

The stationary part 42*a* of rotary union 42 is also fixed relative to yoke 48 and is hollow to duct coolant from an inlet 50 through internal, interconnected chambers to outlet 40. The inlet 50 receives coolant from a further conduit 52 fixed relative to yoke 48 connected to the coolant filter/pump system 26 (FIG. 1) by means of a flexible supply pipe indicated by the pump system outlet 28. Thus, in operation, a continuous supply of coolant flow may be maintained from outlet 28 to the supply nozzles 20*a*,20*b*. The stepper motor 46 may be energised to rotate the conduit 38 and nozzle means 20 about axis 36 to clear the tool volume containing the grinding wheel 2. With a new tool 2 in situ the motor 46 is reversed to rotate nozzle means 20 in the opposite direction towards the periphery of the wheel 2. Preferably, in order to set a predetermined clearance between the tips of nozzles 20*a*,20*b* and the periphery of the wheel the motor 46 incorporates a clutch mechanism (not shown) and reverse torque sensing means (not shown). To obtain the correct clearance stepper motor 46 is advanced until the nozzle tips abut the wheel periphery. The clutch mechanism slips momentarily while the reverse torque sensor acts to disconnect the power supply to motor 46. At this moment the tip(s) of the nozzle(s) should be lightly in contact with the wheel periphery. The motor is then reversed to withdraw the nozzles a predetermined distance, in the illustrated embodiment, a few millimetres corresponding to one or two steps of the stepper motor. Coolant supply may then be re-commenced, if temporarily halted during a tool change operation.

The stepper motor and nozzle means 20, as mentioned above, are carried on a yoke arm 48 which is mounted concentric with the chuck 12 for rotation relative to the machine spindle axis 34. As illustrated in FIG. 2, in this embodiment, the yoke comprises a substantially disc-shaped portion 58 with which the yoke arm 48 is formed integrally to extend in a substantially radial direction relative to the machine axis 34. A portion of the periphery of the circular portion 58 is formed, or machined, as a gear segment which engaged by a gear pinion 60 driven by a prime mover 54, in this case an air-driven motor. The motor 54 is carried by a fixed yoke 56, fixed that is relative to the machine, so that it functions as an earth member. Thus, when motor 54 is energised (in the appropriate sense) the pinion 60 causes the yoke 58 and yoke arm 48 to rotate around the machine axis 34. The effect of this is to shift the aiming point 19 of the nozzle means 20 around the periphery of the grinding wheel 2, in the drawing from initial aiming point 19 with nozzles 20 in solid line to a second aiming point 19 corresponding to the position 20 of the nozzles indicated by dashed lines. The nozzles 20 may be set to any position within the range corresponding to the angle subtended by the gear segment on the periphery of yoke 58. Thus the nozzle means 20 may be set to any desired position to direct a coolant jet at the grinding wheel periphery. The nozzles 20*a*,20*b* are arranged and disposed to direct the jet of coolant in a substantially radial direction, that is substantially perpendicular to a tangent at the aiming point, and because the nozzle means as a whole is rotated in a circumferential direction centred on the machine axis 34 this radial alignment is maintained. In this way use may be made of the multi-axis machining capability of the basic machine during a grinding operation.

What is claimed is:

1. Apparatus for high speed grinding comprises a porous grinding wheel, a machine for mounting and rotating the grinding wheel at peripheral speeds up to about 80 metres per second, a high pressure coolant supply system including at least one nozzle means for directing a jet of coolant at high pressure at an aiming point on the periphery of the grinding wheel, the aiming point being at a position at least twenty degrees in advance of the machining point.

2. Apparatus as claimed in claim 1 wherein the nozzle means is arranged to direct the jet of coolant at the aiming point on the circumference of the grinding wheel in a substantially radial direction.

3. Apparatus as claimed in claim 1 wherein the nozzle means is directed the aiming point on the circumference of the grinding wheel at a distance approximately 30 mm to 40 mm in advance of the machining point.

4. Apparatus as claimed in claim 1 wherein the coolant nozzle means is rotatable about the machine spindle axis in order to re-position the coolant jet aiming point relative to the machining point.

5. Apparatus as claimed in claim 4 wherein the coolant nozzle means is carried by a yoke rotatable about the spindle axis.

6. Apparatus as claimed in claim 5 wherein the yoke is driven by a prime mover.

7. Apparatus as claimed in claim 6 wherein the yoke around at least a portion of its periphery is formed as a gear with which the prime mover is engaged through a pinion.

8. Apparatus as claimed in claim 1 wherein the machine comprises a multi-axis machining centre including an automatic tool changer and the nozzle means is movable in response to a tool change operation to clear a tool volume.

9. Apparatus as claimed in claim 8 wherein the movable nozzle means in order to clear the tool volume is arranged to swing about an axis parallel to but spaced laterally from the machine spindle axis.

10. Apparatus as claimed in claim 8 wherein the movable nozzle means is driven on its swing axis by a separate motor.

11. Apparatus as claimed in claim 10 wherein the swing radius of the nozzle means relative to the lateral spacing between the nozzle swing axis and the machine spindle axis is such that the tip of the nozzle may be rotated to touch the circumference of the grinding wheel.

12. Apparatus as claimed in claim 11 wherein the separate motor includes means for sensing contact between the tip of the nozzle and the circumference of the grinding wheel.

13. Apparatus as claimed in claim 1 wherein the high pressure coolant supply system, in use, delivers a jet of liquid from the nozzle means at a pressure of between about 40–70 Bar.

14. Apparatus as claimed in claim 1 wherein the grinding wheel is composed of aluminium oxide grinding wheel in a porous, vitrified construction.

15. A method of using the apparatus as claimed in claim 1, for carrying out a grinding operation at a very high stock removal rate, comprising the steps of:

setting the grinding wheel for a deep cut at a machining point for either down cut or up cut grinding, and positioning the nozzle means to direct a jet of liquid coolant at very high pressure at an aiming point on the circumference on the grinding wheel in a substantially radial direction at least twenty degrees in advance of the machining point.

16. The method as claimed in claim 15, wherein the positioning step includes positioning the nozzle means to direct a jet of liquid coolant at very high pressure at an aiming point on the circumference of the grinding wheel in a radial direction approximately forty-five degrees in advance of the machining point.

17. The apparatus as claimed in claim 1, wherein the machine rotates the grinding wheel at peripheral speeds of at least 10 meters per second.

18. The apparatus as claimed in claim 1, wherein the aiming point is at a position approximately forty-five degrees in advance of the machining point.

19. A method of using the apparatus as claimed in claim 1, for carrying out a grinding operation at a very high stock removal rate, comprising the steps of:

setting the grinding wheel for a deep cut at a machining point for either down cut or up cut grinding; and positioning the nozzle means to direct a jet of liquid coolant at very high pressure at an aiming point on the circumference on the grinding wheel in a substantially radial direction in advance of the machining point such that the jet of liquid coolant does not directly intersect the machining point.

20. Apparatus for high speed grinding comprises a porous grinding wheel, a machine for mounting and rotating the grinding wheel at peripheral speeds up to about 80 metres per second, a high pressure coolant supply system including at least one nozzle means for directing a jet of coolant at high pressure at an aiming point on the periphery of the grinding wheel substantially in advance of the machining point such that the jet of coolant does not directly intersect the machining point.

* * * * *